US010488029B2

(12) United States Patent
Wandrey

(10) Patent No.: US 10,488,029 B2
(45) Date of Patent: Nov. 26, 2019

(54) LED HEAT PIPE ASSEMBLY

(71) Applicant: Sternberg Lanterns, Inc., Roselle, IL (US)

(72) Inventor: John Wandrey, Mount Prospect, IL (US)

(73) Assignee: Sternberg Lanterns, Inc., Roselle, IL (US)

( * ) Notice: Subject to any disclaimer, the term of this patent is extended or adjusted under 35 U.S.C. 154(b) by 18 days.

(21) Appl. No.: 15/896,153

(22) Filed: Feb. 14, 2018

(65) Prior Publication Data

US 2019/0249857 A1 Aug. 15, 2019

(51) Int. Cl.

| | |
|---|---|
| ***F21V 29/503*** | (2015.01) |
| ***F21V 29/51*** | (2015.01) |
| ***F21V 29/507*** | (2015.01) |
| ***F21V 29/71*** | (2015.01) |
| ***F21Y 115/10*** | (2016.01) |

(52) U.S. Cl.

CPC ..... *F21V 29/503* (2015.01); *F21V 29/507* (2015.01); *F21V 29/51* (2015.01); *F21V 29/717* (2015.01); *F21Y 2115/10* (2016.08)

(58) Field of Classification Search

CPC .... F21V 29/503; F21V 29/717; F21V 29/507; F21V 29/51; F21V 29/00; F21Y 2115/10; F21S 45/40

See application file for complete search history.

(56) References Cited

U.S. PATENT DOCUMENTS

| | | | | |
|---|---|---|---|---|
| 2012/0120631 | A1* | 5/2012 | Zhang | F21V 29/713 362/97.1 |
| 2014/0078737 | A1* | 3/2014 | Lin | F21V 29/006 362/249.02 |
| 2015/0330617 | A1* | 11/2015 | Hoetzl | F21V 23/006 362/373 |
| 2016/0201891 | A1* | 7/2016 | Wandrey | F21V 29/503 362/294 |
| 2016/0245495 | A1* | 8/2016 | Lin | F21V 7/0008 |
| 2017/0023228 | A1* | 1/2017 | Dyson | F21S 8/06 |
| 2017/0104135 | A1* | 4/2017 | Shur | H01L 33/486 |
| 2017/0205063 | A1* | 7/2017 | Kadijk | F21V 29/006 |
| 2018/0149547 | A1* | 5/2018 | Ramirez | G01M 3/02 |
| 2018/0156441 | A1* | 6/2018 | Wang | F21V 29/51 |
| 2018/0158756 | A1* | 6/2018 | Smoot | H01L 23/427 |
| 2018/0184513 | A1* | 6/2018 | Arik | H05K 1/0203 |
| 2018/0252476 | A1* | 9/2018 | Johnson | F28D 15/0275 |
| 2018/0323348 | A1* | 11/2018 | Ramirez, III | H01L 33/483 |

* cited by examiner

*Primary Examiner* — Joseph L Williams
*Assistant Examiner* — Jose M Diaz
(74) *Attorney, Agent, or Firm* — Seyfarth Shaw LLP

(57) ABSTRACT

A lighting device that includes a heat sink coupled to a heat dissipation structure. The heat dissipation structure can include heat conduits operatively coupled to a light emitting device to receive and emit heat from the light emitting device. The heat conduits conduct heat from the light emitting device to the heat sink that is disposed above the light emitting device to protect the internal components of the lighting device.

17 Claims, 5 Drawing Sheets

LED HEAT PIPE ASSEMBLY

TECHNICAL FIELD OF THE INVENTION

The present application relates generally to heat dissipation systems. More particularly, the present application relates to an assembly that efficiently dissipates heat from a LED.

BACKGROUND OF THE INVENTION

Light emitting diodes ("LEDs") are energy efficient devices that emit light. LEDs are typically more durable and require less power than conventional lighting technology, making them ideal for lights frequently in use, such as, for example, street lights. However, LEDs produce heat as a by-product of light production and such heat can damage the surrounding structure or LED if it not effectively dissipated.

Currently, LED heat dissipation assemblies include a heat sink with, for example, fins to dissipate the heat from the lighting device to the environment. The heat sink is typically connected to the LED so heat is conducted directly or indirectly from the LED to the heat sink, and ultimately, away from the lighting device.

Conventional heat dissipation assemblies require direct or near direct connection between the heat sink and LED to effectively receive and dissipate heat. The heat sink must also be exposed to the outside atmosphere and/or weather to disperse excess heat away from the LED device, thus causing concerns of corrosion, leakage, and the like. These spatial constraints, in addition to the necessary bulk of the heat sink, limit the locations for other parts of the LED device and inefficiently dissipate heat.

SUMMARY OF THE INVENTION

The invention broadly comprises a lighting device that includes a heat sink coupled to a heat dissipation structure. The heat dissipation structure can include a series of heat conduits, or pipes, that are effectively disposed near a lighting element, such as, for example, a an LED device, to receive and transfer heat from the lighting element. The heat conduits conduct heat from the lighting element across a heat sink, which then emits the heat away from the lighting device, to protect the internal components of the lighting device, while still enabling distal placement of the heat sink relative to the lighting element.

In an embodiment, the present invention broadly comprises a lighting device including a light emitting structure, a housing adapted to house the light emitting structure and a heat dissipation structure coupled to the housing. The heat dissipation structure may include a heat sink plate defining at least one groove and at least one mounting surface to receive the light emitting structure. The heat dissipation structure may also include at least one conduit conductively coupled to the heatsink plate and disposed in the groove at a position to receive heat emitted from the light emitting structure.

In another embodiment, the present invention broadly comprises a heat dissipation structure including a heat sink having a lower surface defining at least one mounting surface located opposite a groove. At least one light-emitting device may be affixed to the at least one mounting surface and at least one heat conduit may be conductively coupled to the heat sink. The at least one heat conduit may be adapted to transfer heat away from the at least one light emitting device.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 2A:
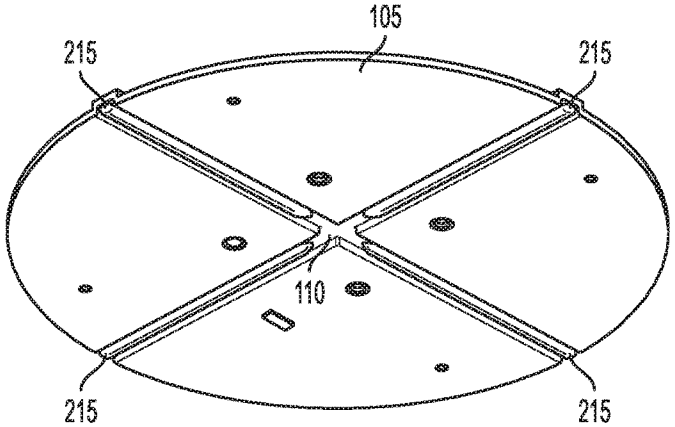
FIG. 2A is a perspective view of a heatsink assembly with heat dissipating conduits disposed on the heatsink plate according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

In an embodiment, the present invention broadly comprises a lighting device that includes a light emitting source, such as, for example, a chip-on-board ("COB") light emitting diode ("LED") device, a heat sink and conduits or heat pipes operatively arranged and connected to the heat sink and disposed above an LED device in a manner designed to effectively and efficiently draw heat away from the light emitting source. In an embodiment, the increased heat transfer capabilities of the heat pipe described may improve the light output of the design. Additionally, the advantageous design may reduce heat sink size and accordingly, the material reduction may provide weight and cost reduction.

In an embodiment, the heat sink assembly consists of copper heat pipes imbedded into grooves found on the die cast aluminum heat sink.

Figure 1:
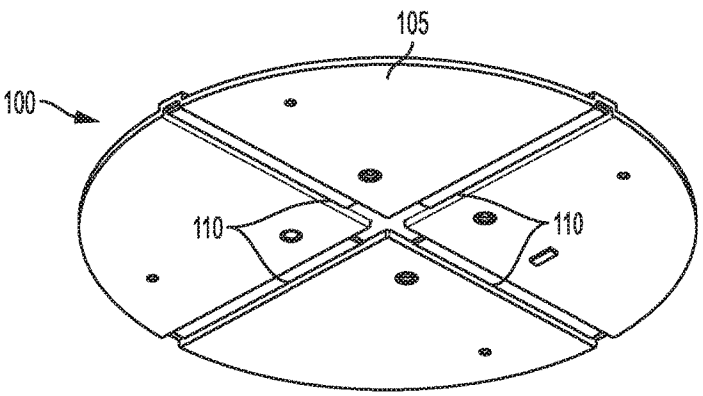
FIG. 1 is a perspective view of a heat sink plate according to an embodiment of the present invention.

Referring to FIG. 1, a perspective view 100 of a heat sink plate 105 in accordance with one embodiment is shown. The heat sink plate 105 may include a die-cast aluminum plate with one or more grooves 110 defined in a top surface of the plate 105. The grooves 110, according to an embodiment, form crossing channels spanning the diameter of the circular heat sink plate 105. In another embodiment, the grooves 110 may be defined as extending radially from a center portion of the heat sink plate 105. As explained below, the grooves are operationally positioned to lie above a heat-emitting, light source, such as an LED device, mounted or affixed to the under-side of the heat sink 105. The heat sink plate 105 may further define threaded holes or other attachment fixtures adapted to receive screws or other fasteners to attach additional components to the lighting device.

Figure 2C:
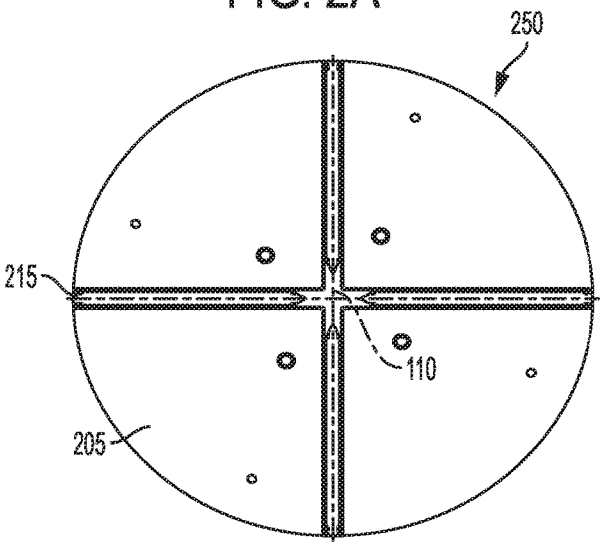
FIG. 2C is a top-view of a heatsink assembly with heat dissipating conduits disposed on the heatsink plate according to an embodiment of the present invention.
Figure 2B:
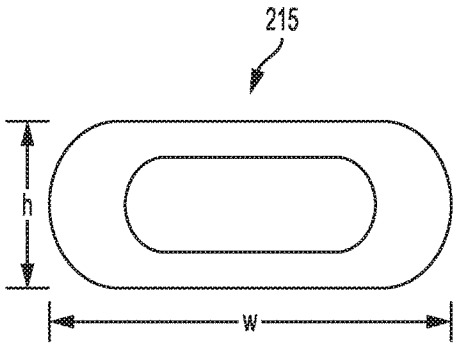
FIG. 2B is a cross-section view of a heat pipe in according to an embodiment of the present invention.

Referring to FIG. 2A, the heatsink plate 105 with heat dissipating conduits or heat pipes 215 disposed in the grooves 110 of the heatsink plate 105 is shown. FIG. 2C is a top-view of a similar assembly. The grooves 110 may be defined and sized to receive heat pipes 215 wherein a top surface of the heat pipe 215 is substantially level with the top surface of the heatsink plate 105. FIG. 2B is a cross-section view of a heat pipe 215 according to an embodiment of the present invention. The heat pipe 215 may have a width 'w' having dimensions conforming to the size and shape of the grooves 110 of the heat sink plate 105. The heat pipe 215 may have a height 'h' conforming to a depth of the grooves 110 of the heat sink plate 105, such that when the heat pipe 215 is affixed to the heat sink plate 105, the top surface of the heat pipe 215 is substantially level with the top surface of the heat sink plate 105.

The heat pipe 215 may be made of any material, and may be any structure that allows for the transfer of heat from a heat emitting structure through the heat sink plate 105. As shown, the heat pipe 215 may substantially linear and made from copper. The heat pipe 215 may be substantially cylindrical, round or rectangular depending on the definition of the grooves 110. The heat pipe 215, as shown, may be tubular in nature, i.e., can be hollow inside, to allow for even greater surface area to dissipate heat. In this manner, the heat pipe 215 can absorb heat from the heat source and direct the heat away from the source through and across the heat sink plate 105. According to one embodiment, the heat pipe 215 may be flattened or have substantially flat portions along its length. The flattened portions of the heat pipe 215 may provide greater surface area at the point of contact with the heatsink 105. According to yet another embodiment, the heat pipe 215 may be coated with a wicking agent or other coating to improve heat transfer from the heat pipe 215 to a vapor or gas which may then be expelled via the hollow channel of the heat pipe 215.

In an embodiment, the heat pipes 215 may be affixed to the heatsink plate 105 using a conductive adhesive, such as an aluminum filled, heat sink bonding resin. The resin or epoxy may be mixed with a hardener further enhancing the adhesive bond formed between the heat sink plate and the heat pipe 215.

Figure 3A:
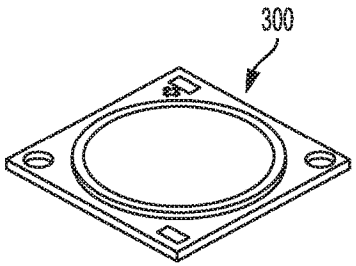
FIG. 3A is a perspective view of an exemplary COB LED device.

FIG. 3A is a perspective view of an exemplary COB LED device 300. A COB LED 300 may be comprised of multiple LED chips (for example, nine or more) bonded or secured directly to a substrate to form a single module. The individual LEDs used in a COB 300 are chips and not traditionally packaged, therefore the chips can be mounted such that they take up less space and the highest potential of the LED chips can be obtained. When a COB LED package 300 is powered, through electrical connection to a power source (not shown), the device may appear more like a single light or light panel as opposed to multiple individual lights when using several surface mounted device ("SMD") LEDs mounted closely together.

Figure 3B:
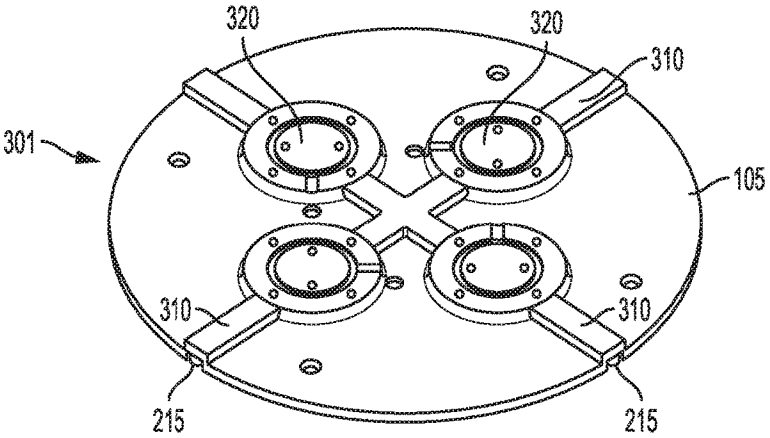
FIG. 3B is a perspective view of the underside of a heat sink assembly according to an embodiment of the present invention.
Figure 3C:
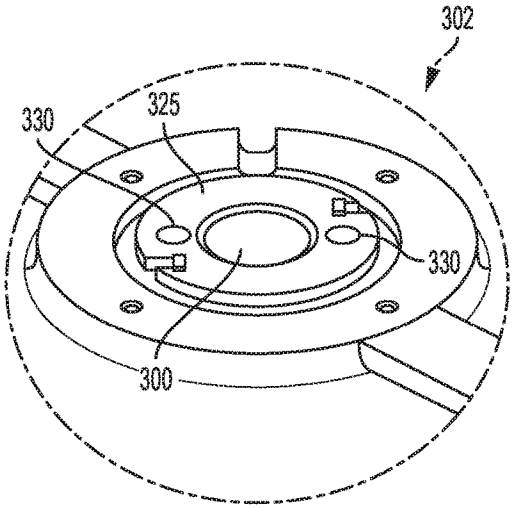
FIG. 3C is a detailed view of a COB LED mounting surface according to according to an embodiment of the present invention.
Figure 3D:
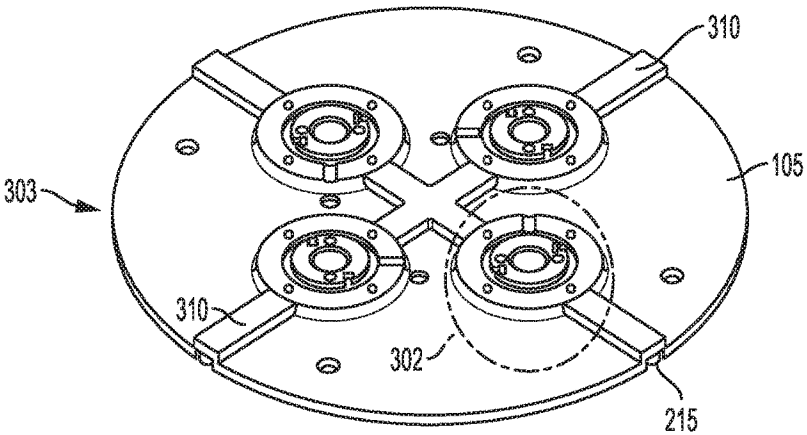
FIG. 3D is a perspective view of the underside of the heat sink assembly according to an embodiment of the present invention.

FIG. 3B is a perspective view 301 of the under-side of the heatsink plate 105. The underside grooves 310 may extend below the bottom surface of the heat sink plate 105 to accommodate the heat pipes 215. The underside of the heat sink plate 105 may include mounting surfaces 320 for the COB LED devices. Each mounting surface may include threaded or otherwise defined holes to receive fasteners securing the COB LED 301 with a cover as well as other protective components such as a lens or transparent cover. FIG. 3C is a detailed view 302 of the COB LED mounting surface 320 with the COB LED device 300 in place and retained by a COB cover 325. FIG. 3D is a perspective view 303 of the underside of the heat sink assembly with the COB LEDs 300 affixed to the mounting surfaces 320. In an embodiment, the COB cover plate 325 may be circular with a defined aperture surrounding the light-emitting portion of the COB 300. The cover plate 325 may be affixed to the mounting surface 320 and over the COB LED 300 using threaded screws or other suitable fasteners installed in the cover plate holes 330.

Figure 4A:
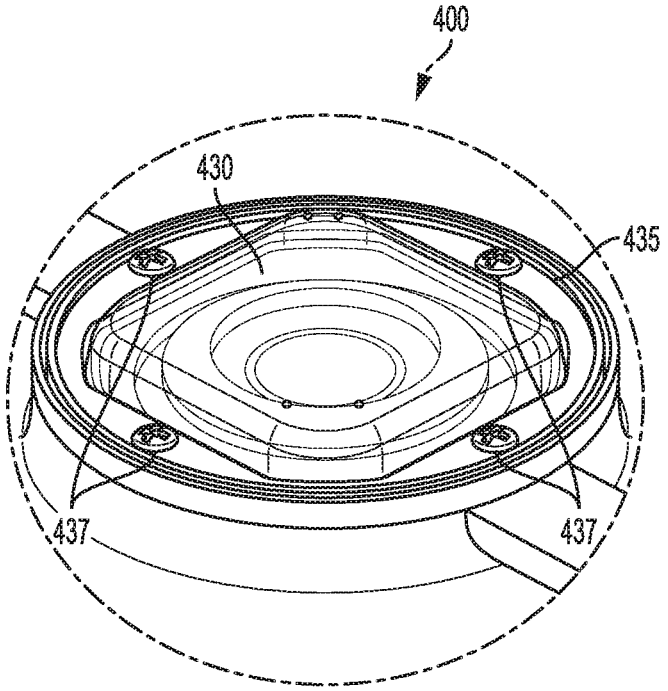
FIG. 4A is detailed view of a lens assembly according to according to an embodiment of the present invention.
Figure 4B:
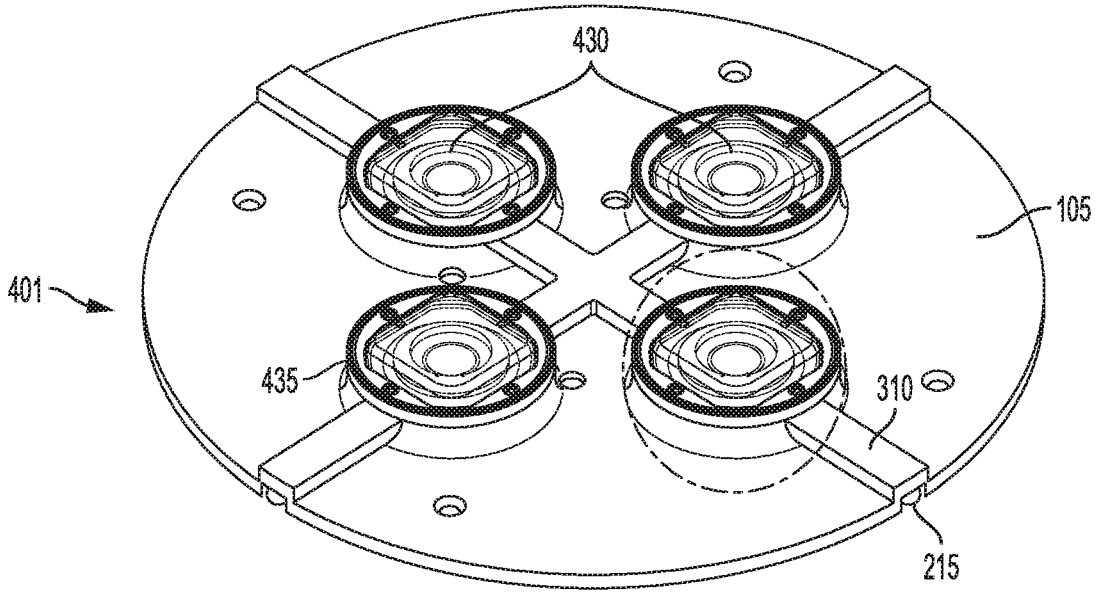
FIG. 4B is a perspective view of the underside of a heat sink assembly according to an embodiment of the present invention.

FIG. 4A is a detailed view 400 of a lens assembly installed over a COB LED in accordance with an embodiment of the present invention. A lens 430 may be disposed over the COB LED and retained by a lens holder 435 using threaded screws 437 or other similar fasteners. FIG. 4B is a perspective view 401 of the underside of the heat sink plate 105 with lens 430 and lens holder 435 installed over the COB LED.

Figure 5:
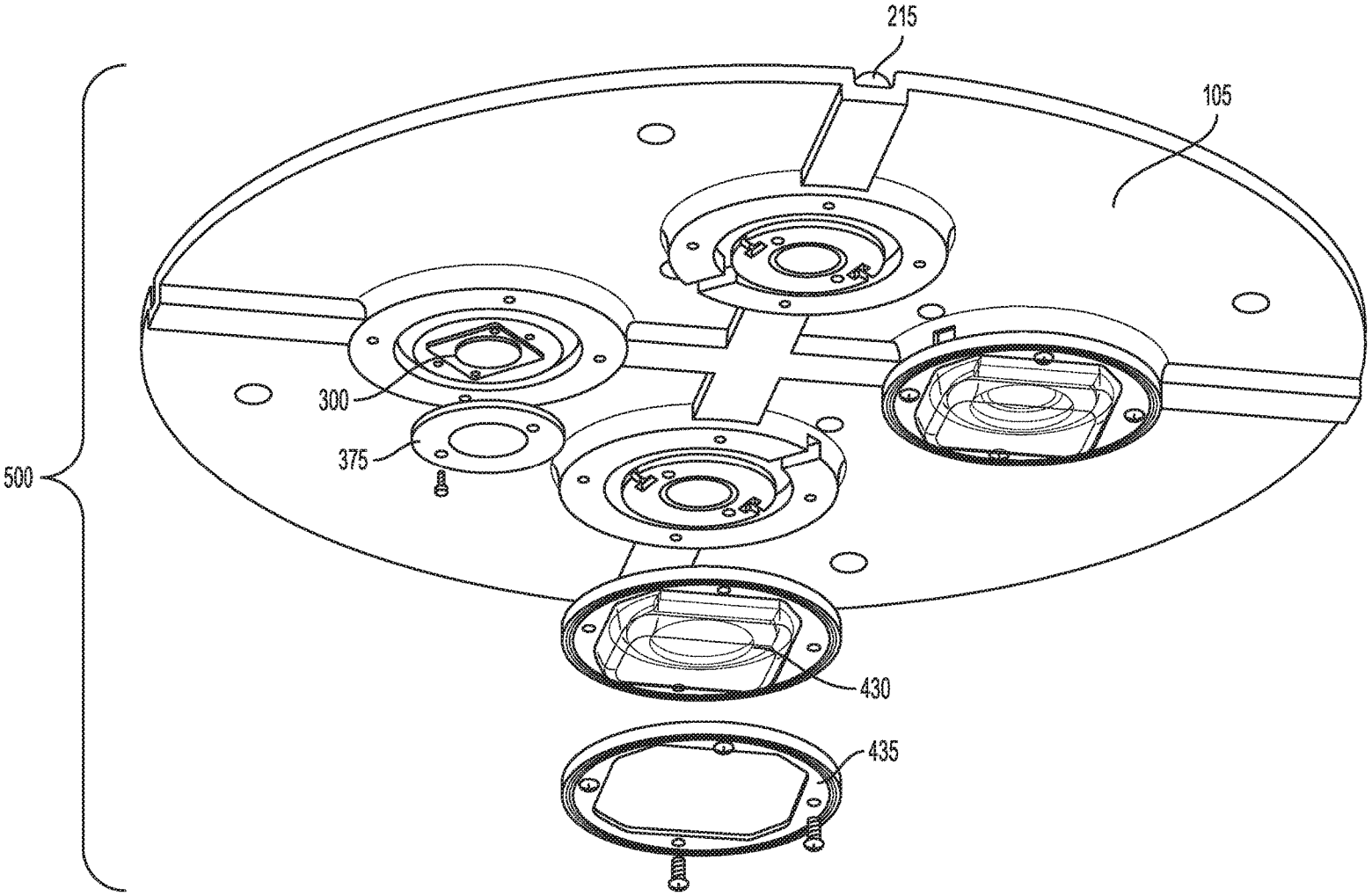
FIG. 5 is a exploded view of a heat sink assembly according to an embodiment of the present invention.

FIG. 5 is an exploded view 500 of a heat sink assembly according to an embodiment of the present invention. The heat sink assembly may include heat sink plate 105 with heat pipes 215 disposed in and affixed to the grooves 110 with an aluminum epoxy or other heat-conductive adhesive. A COB LED 300 may be mounted to a mounting surface 320 and retained by a COB holder 325. A lens 430 may be disposed over the mounted COD LED and secured to the mounting surface 320 of the heat sink assembly 105 by a lens holder 435 using threaded screws 437.

In operation, when one or more COB LED devices are powered, heat may be generated that, unless drawn away from the electronics of the LED, may disrupt or damage the COB and surrounding components. According an embodiment of the present invention, heat from the operation of the COB LED may be drawn upwardly through the heat sink plate 105 and into the heat pipe 215 which may be formed from a superior conductor than the heat-sink material. For example, a die-cast aluminum heat sink plate 105 may draw heat from the COB LED 300 upward into heat pipes 212 made of copper. Copper, being a superior conductor of heat compared to aluminum, may draw the heat from the heat sink plate 105 surrounding the COB LED 300 and dissipate the heat across the heat pipe and portions of the heat sink plate 105 leading away from the COB, and thereby avoiding excessive heat localized on or around the COB LED 300, the mounting surface, 320, and lens 430.

Figure 6:
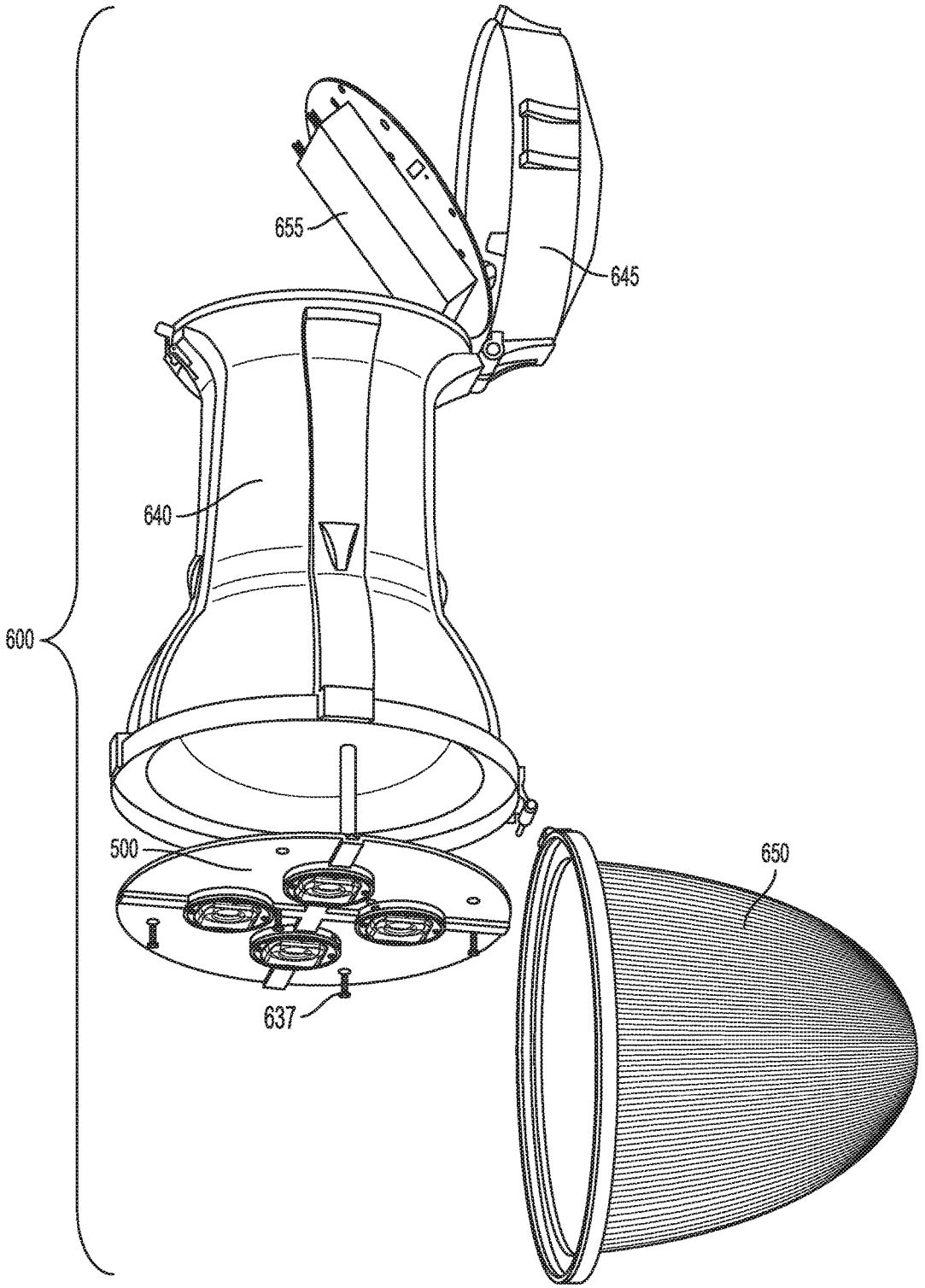
FIG. 6 is an exploded view of a lighting device according to an embodiment of the present invention.

FIG. 6 is an exploded view 600 of a lighting device including the heat sink assembly 500 described herein. A light housing 640 may form the body of the lighting device. The housing 640 may be a die cast housing made from a material that may further assist in dissipating heat from the heat pipes and heat sink assembly 500. Contact points, including those through attachment screws 637, between the heat sink assembly 500 and the housing 640 may serve as conduits for heat to be transferred and further directed away from the lighting electronics. A light fixture may be disposed over the heat sink assembly 105 for decorative or protective purposes. A driver 655 electrically connected to a power source and the light source may also be included in the upper housing 640 to control operation of the COB LED. For example, the driver 655 may control the times at which the COB LED is illuminated, and the frequency or intensity at which the LEDs are illuminated. The driver 640 may also control output of power to the LEDs so as not to under-power or over-power the LEDs and cause a malfunction.

While aspects of the invention are described herein using COB LEDs, it will be appreciated that other lighting devices and heat sources may be implemented without deviating from the scope of the present disclosure. Additionally, while the heat sink assembly 500 described herein is shown including mounting surfaces for four lighting sources, it will be appreciated that other configurations of light sources, heat pipes and heat sink plates are within the scope of the disclosure, particularly those designed and configured to dissipate heat generated by the light source in the manner described herein.

As discussed herein, the term "coupled" is intended to refer to any connection, direct or indirect, and is not limited to a direct connection between two or more elements of the disclosed invention. Similarly, "operatively coupled" is not intended to mean any direct connection, physical or otherwise, and is merely intended to define an arrangement where two or more elements communicate through some operative means (e.g., through conductive or convective heat transfer, or otherwise).

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A lighting device having a housing adapted to house a light emitting structure comprising:

a heat dissipation structure coupled to the housing and including:

a heat sink plate having first and second surfaces, the first surface defining a groove and the second surface defining a mounting surface to receive the light emitting structure; and a conduit conductively coupled to the heatsink plate and disposed in the groove at a position to receive heat emitted from the light emitting structure.

2. The lighting device of claim 1, wherein the light emitting structure is a light emitting diode (LED).

3. The lighting device of claim 2, wherein the LED is a chip-on-board LED.

4. The lighting device of claim 1, wherein the heat sink plate includes a die-cast aluminum plate.

5. The lighting device of claim 1, wherein the conduit is a copper heat pipe.

6. The lighting device of claim 5, wherein the copper heat pipe defines a hollow channel.

7. The lighting device of claim 5, wherein the copper heat pipe is substantially cylindrical.

8. The lighting device of claim 1, further comprising a lens disposed over the lighting device.

9. The lighting device of claim 1 further comprising a driver configured to control the lighting source.

10. The lighting device of claim 1, wherein the conduit is conductively coupled to the heat sink plate with an aluminum filled bonding resin.

11. A heat dissipation structure comprising:

a heat sink having upper and lower surfaces, the lower surface defining a mounting surface;

a light-emitting device affixed to the mounting surface; and a heat conduit conductively coupled to the upper surface of the heat sink, wherein the heat conduit is adapted to transfer heat away from the light emitting device.

12. The heat dissipation structure of claim 11, wherein the upper surface defines a groove adapted to receive the heat conduit, and wherein a portion of the groove is defined opposite the mounting surface.

13. The heat dissipation structure of claim 12, wherein the heat sink is substantially circular and the groove extends radially from the center of the heat sink.

14. The heat dissipation structure of claim 11, wherein the heat conduit includes a copper heat pipe.

15. The heat dissipation structure of claim 11, further comprising a driver configured to control the light emitting device.

16. The heat dissipation structure of claim 11, wherein the light emitting structure is an LED.

17. The heat dissipation structure of claim 11, wherein the at least one heat conduit is conductively coupled to the heat sink by an aluminum filled, heat sink bonding resin.

* * * * *